United States Patent [19]

Bogucki-Land

[11] Patent Number: 4,715,097

[45] Date of Patent: Dec. 29, 1987

[54] ARRANGEMENT FOR THE ENTANGLEMENT OF MULTI-FILAMENT THREADS

[75] Inventor: Bogdan Bogucki-Land, Offenbach, Fed. Rep. of Germany

[73] Assignee: Karl Mayer textilmaschinenfabrik GmbH, Fed. Rep. of Germany

[21] Appl. No.: 914,945

[22] Filed: Oct. 3, 1986

[30] Foreign Application Priority Data

Oct. 4, 1985 [EP] European Pat. Off. ..... 85112571.6

[51] Int. Cl.[4] ..... D02H 5/02; D02J 1/08

[52] U.S. Cl. ..... 28/172; 28/272; 28/274

[58] Field of Search ..... 28/172, 271, 272, 274, 28/275, 276; 57/333, 350

[56] References Cited

U.S. PATENT DOCUMENTS

| | | | |
|---|---|---|---|
| 3,022,566 | 12/1962 | Daniels et al. | 57/333 X |
| 3,120,733 | 12/1964 | Breen | 57/333 X |
| 3,353,344 | 11/1967 | Clendening, Jr. | 57/333 X |
| 3,367,100 | 2/1968 | Hughey | 28/276 X |
| 4,152,886 | 5/1979 | Nelson | 28/271 X |
| 4,422,224 | 12/1983 | Gusack et al. | 28/274 X |
| 4,592,119 | 6/1986 | Bauer et al. | 28/271 |
| 4,633,550 | 1/1987 | McAliley et al. | 28/276 X |
| 4,644,622 | 2/1987 | Bauer et al. | 28/271 |

FOREIGN PATENT DOCUMENTS 1576355 10/1980 United Kingdom ..... 28/276

*Primary Examiner*—Robert R. Mackey
*Attorney, Agent, or Firm*—Omri M. Behr

[57] ABSTRACT

An arrangement for the entanglement of multi-filament thread can entangle warp threads travelling from spools on a creel to a warping machine. This arrangement has a jet arm adapted to communicate with a source of compressed air. The arrangement has a plurality of adjacently placed plates. Each adjacent pair of the plates has a separating element located between each. These plates are positioned to provide between them a plurality of parallel channels. Each of these channels is shaped as an outwardly directed slot having side walls formed by a corresponding adjacent pair of the plates. The slot has a base formed by the separating element corresponding thereto. For each adjacent pair of the plates, at least one of them includes: (a) a reservoir adapted to communicate with the source of compressed air, and (b) a bore in the side wall communicating with the reservoir for acting as a perpendicularly directed air jet. The plates have in their slots upstream and downstream of the air jets, at least one thread support for keeping the threads out a predetermined distance from the base of the slot and in the influence of the air jet.

13 Claims, 9 Drawing Figures

ARRANGEMENT FOR THE ENTANGLEMENT OF MULTI-FILAMENT THREADS

BACKGROUND OF THE INVENTION

1. Field of the Invention

The present invention is directed to an arrangement for the entanglement of multi-filament threads comprising a plurality of parallel, adjacently arranged channels into each of which is directed at least one perpendicularly oriented air jet. The arrangement is particularly suited for the entanglement of warp threads being transferred from the creel to the warping machine.

2. Discussion of the Relevant Art

In a known arrangement of this type (W. German Application DE-OS No. 26 11 547), the warp threads coming from the creel are led through a channel plate which comprises a plurality of cylindrical channels oriented over each other and next to each other. These channels have at their exit end a ceramic thread guide eyelet of smaller diameter. Radial bores provide the air jets. The compressed air is provided from a reservoir in the channel plate. This arrangement requires a great deal of space. Also associated therewith is an undesired angular deflection of the individual warp threads both with respect to height and breadth. Difficulties are also caused by the need to thread the threads through the individual channels. The noise generated by the system is considerable. When the channels are not utilized, there is an unnecessary consumption of compressed air.

It is also known (W. German Application DE-AS No. 1214 82 5) to provide these channels in the form of slots, to provide the air jets as orifices in the side walls and to hold the threads in the slots in the neighborhood of the jets by means of pegs running through said slots. The problem with single thread entanglement is that the threads when they are to be adjacently warped on a warp beam, must be individually spooled which gives rise to considerable financial, space and worker costs. Furthermore, it has been noted that when such threads are warped on a warp beam or partial warp beam, certain irregularities in warping occur.

SUMMARY OF THE INVENTION

In accordance with the illustrative embodiments demonstrating features and advantages of the present invention, there is provided an arrangement for the entanglement of multi-filament thread. The arrangement is operable to entangle warp threads travelling from spools on a creel to a warping machine. This arrangement has a jet arm adapted to communicate with a source of compressed air. The arrangement has a plurality of adjacently placed plates. Each adjacent pair of the plates has a separating element located between each. These plates are positioned to provide between them a plurality of parallel channels. Each of these channels is shaped as an outwardly directed slot having side walls formed by a corresponding adjacent pair of the plates. The slot has a base formed by the separating element corresponding thereto. For each adjacent pair of the plates, at least one of them includes: (a) a reservoir adapted to communicate with the source of compressed air, and (b) a bore in the side wall communicating with the reservoir for acting as a perpendicularly directed air jet. The plates have in their slots upstream and downstream of the air jets, at least one thread support for keeping the threads out a predetermined distance from the base of the slot and in the influence of the air jet.

It is an object of the present invention to provide an entanglement arrangement of the aforementioned type in which the channels are provided in a spatially economical manner. In particular, the warp threads, which are turbulated in the warping process are handled in such a manner that they stray as little as possible from the plane of the warp, having substantially parallel running warp threads.

The object of this invention is attained thereby that a jet arm is provided from a plurality of adjacent and spaced plate elements. Each channel is created in the form of an outwardly directed slot whose sides are formed by neighboring plates and whose base is formed by a separation element. At least one of the two plates is provided with a compressed air reservoir connected to a air provision channel and at least one bore which acts as an air jet opening into the side wall. Thread supports located before and after the air jets ensure that the threads are separated from the base of the slot in the vicinity of influence of the air jet. Because of the advantageous design, the noise level is substantially less than in the case of cylindrical channels.

In another preferred embodiment, an axially displacable sealing block is provided to be movable along the axis of the air provision channel. The purpose of the block is to separate those air jet whose slots are not loaded with threads from the rest of the air provision channel. This provides for savings in compressed air useage. It has been found useful to provide this block at one end of a setting screw whose free end protrudes from the jet arm and is there provided with an activation arrangement. As activation arrangement, there may be used, for example, a knurled knob.

BRIEF DESCRIPTION OF THE DRAWINGS

The invention may be illustrated by reference to the drawings of certain embodiments briefly described hereinbelow.

(1)

(2)

(3)

(4)

(5)

(6)

(7)

(8)

DETAILED DESCRIPTION OF THE DRAWINGS

Figure 1:
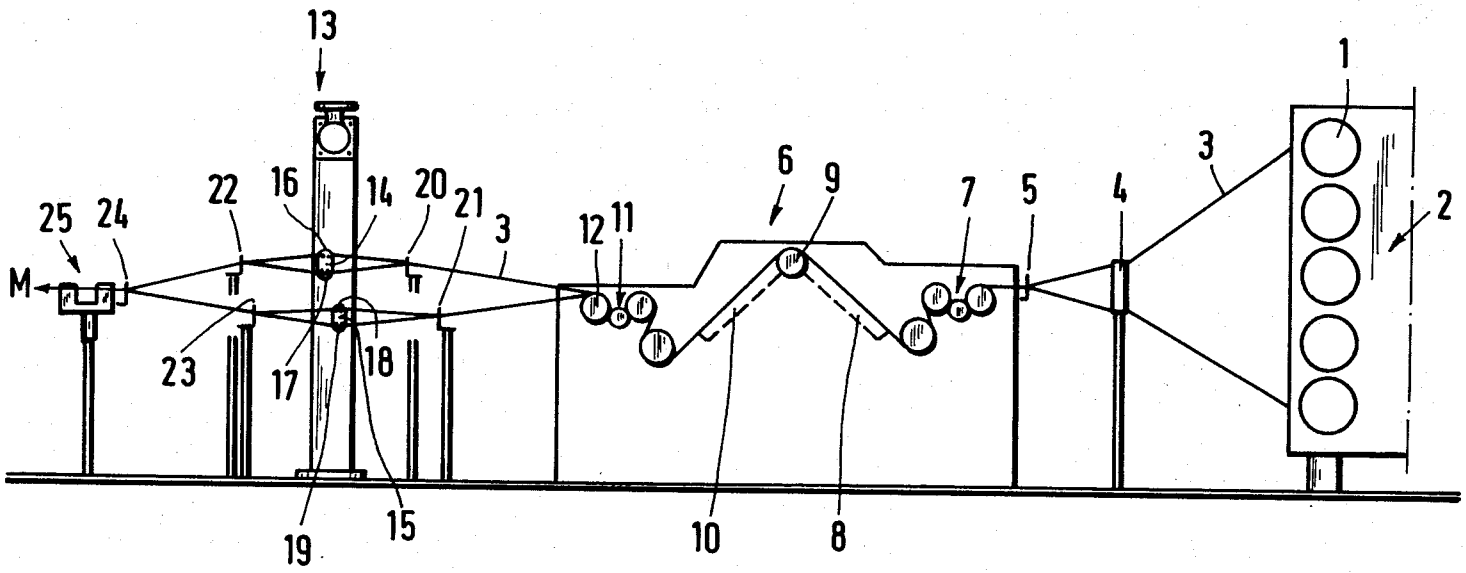
FIG. 1 is a schematic side elevational view of the tanglement arrangement portion of a stretch warp arrangement.

In FIG. 1, there is illustrated a plurality of spools 1 on a creel 2 equipped with thread brakes. The warp threads 3 are pulled from the spools 1 and run through eyelet reed 4 and from there to collecting reed 5 before entering the heat stretching arrangement 6. Such a heat stretching arrangement may be, for example, one similar to that illustrated in W. German Application DEOS No. 3328449, the disclosure of which is incorporated herein by reference. The warp threads 3 are forwarded by a set of tension rollers 7, heated by heating arrangement 8, and pulled over turning roller 9, at which point stretching occurs. Further heat is applied by a further heating arrangement 10 before finally taking threads 3 off by a further roller set 11, which runs at a higher speed than the speed achieved by take-off rollers 7.

The last roller 12 of the roller set 11 serves as a distribution arrangement for the threads which now enter an arrangement 13 for the entanglement of the threads. This arrangement comprises a pair of jet arms 14 and 15 which each comprise two of the slot rows 16 and 17 or 18 and 19 serving as slots for the entanglement process.

The actual distribution of the warp threads 3 is achieved through distribution reeds 20 and 21. The collection of these threads occurs through collecting reeds 22 and 23 as well as a general collection arrangement 24 also in the form of a reed. Subsequent thereto, there is provided a further general arrangment 25, for example, an optical thread watch, an oiling arrangement, and the like. Thereafter, the warp threads are led to a warping machine M where they are wound onto warp beams in the conventional manner.

Figure 2:
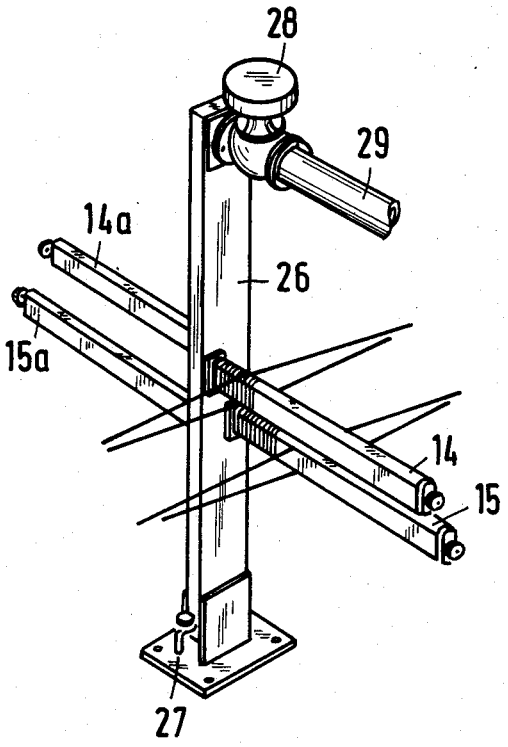
FIG. 2 is a downward perspective view of the entanglement arrangement of FIG. 1.

FIG. 2 shows a carrier 26 attached to a footing arrangement 27, in the form of a mounting flange. The carrier 26 is hollow. Connected to feed the internal hollow or reservoir of carier 26 is a reduction valve 28 connected to a main compressed air line 29. On one side of the carrier 26 are provided parallel jet arms 14 and 15 and on the other side, at the corresponding level, there are provided jet arms **14*a* and 15*a*. These jet arms are provided with compressed air from the reservoir of the carrier 26**.

It has been found to be advantageous for the jet arms **14, 15, 14*a* and 15*a* to be attached at one end thereof to carrier 26 in such a way that air flowing in an airway (shown hereinafter) in the jet arm is fed by the carrier 26**. Since mechanical connection and air provision can be coupled together, this gives rise to a very simple construction.

Providing a pair of jet arms 14 and **14*a* (as well as 15 and 15*a***) at substantially the same level on opposite sides of the carrier enables the handling of a double width of warp sheet without increasing the constructive difficulties.

The jet arms **14, 14*a*, 15, 15*a*** give rise to a stable form of construction which is relatively easy to assemble. It is particularly advantageous if the air provision channel runs through the jet arm. This gives rise to a compact form of construction.

The best results are obtained when both of the support rows of a jet arm are oriented symmetrically above and below the combination level between a separating arrangement and a gathering arrangement.

As shown in FIGS. 2 to 5, each jet arm **14, 14*a*, 15, and 15*a* is comprised of a plurality of plates 30 interleaved with separators 31 therebetween. With two jet arms, such as arms 14 and 15, above each other on the carrier 26**, and each having two slot rows, it is then possible to treat four weft threads on one plate and one separator disk without substantial angular deviation in the vertical direction. In the horizontal direction utilizing this slot multiplication, there are in most cases substantially no angular deviations.

In a preferred embodiment, the plates 30 have planar, parallel frontal areas and the separation elements 31 are formed by discs laid therebetween. The components of the jet arm are easily assembled.

The plates 30 should be preferably constructed of ceramic, in particular, oxide ceramic. This increases the life of the components. Ceramic plates can be constructed by means of normal forming processes and be fired thereafter. The plates 30 have, for example, a width of 3.5 mm and the separation elements 31 a width of about 5 mm. In this way four slots 36 and 37 are provided for each 4 mm so that approximately 1 mm is available per thread. This is a very advantageous spacing for warp threads.

Furthermore, the separation plate 31 can act as a gasket separating the slot from the air provision channel (discussed hereinafter). Such dual functioning separating plates 31 can, for example, be stamped out of sheeting material.

This overall form of construction makes it possible to provide the entanglement channels 36, 37 close to each other; their breadth is determined by the thickness of the separation plates 31 and their separation from each other by the thickness of the plates 30 themselves. The threads 3 may be readily laid into the slots 36, 37 since the slots are open on their outside.

Thread supports 32 through 35 are provided by pins running axially through the jet arms **14, 14*a*, 15, 15*a* and protruding through slots 36 and 37. In the illustrated embodiments, these pegs 32–35 are utilized in the form of tension bolts connected to the carrier 26 which hold the plates 30 and the separating elements 31 together. It is advantageous if the thread supports 32–35 are formed by pegs protruding partially into the slots. The pegs are constructed in such a manner that one peg provides a plurality of thread supports. In particular, the pegs 32–35** can serve as tension bolts. The double function of the tension bolts simplifies the total construction.

The separating elements 31 (FIG. 4) have a lesser height than the plate 30 (FIG. 3) so that in the assembled condition outwardly directed slots 36 and 37 are formed which provide two mutually parallel slot rows 16 and 17. It is particularly advantageous to provide that the jet arm is equipped with two similar slot rows 16, 17 lying on top of each other on opposite sides of the air provision channel (to be described presently). In this manner, it is possible to provide two slots from a given plate thickness with only a very small displacement, which enables the handling of twice the number of threads even though a rather small angular displacement of the threads is required.

In many cases, it is advantageous that the slots 36 and 37, on their open side, are provided with an exit prevention device. In particular, the exit prevention device can be formed by a wire 40, 41 which runs through adjacent bores 38, 39 in the plates 30. There are provided small bores 38 and 39 near the top and bottom edge, respectively, in plates 30 through which may be threaded wires which form exit guards 40 and 41 and prevent the threads 3 from being blown out of the slots 36 and 37. Such an exit prevention means serves to control blowout of the threads under normal conditions, but enables easy removal thereof when it is desired to lay a thread into a slot 36, 37.

Each plate 30 comprises a substantially circular opening 42 therein and similarly each separation element 31 has a circular opening 43 therein which, in combination, form the compressed air channel, identified herein as airway 44. Extending in radially opposite directions from aperture 42, in the middle of each of the shorter sides of plates 30 there are provided reservoir spaces 45 and 46 opening into channel 44. It can be particularly provided that the air provision channel 44 is formed through openings in the plates 30 and separating elements 31 and the reservoirs 45, 46 are provided by pockets opening out from the openings in the plates which are closed off on both sides by the plate material except for the air jets 47 and 48 themselves. This reservoir space is enclosed on both sides by the plate material and leads to other boards designated as air jets 47 and 48 which open into the side walls of 36 and 37. It is sufficient to provide flat pockets in order to serve the jets 47, 48 so that the plates 30 need only have a minimal thickness.

Figure 6:
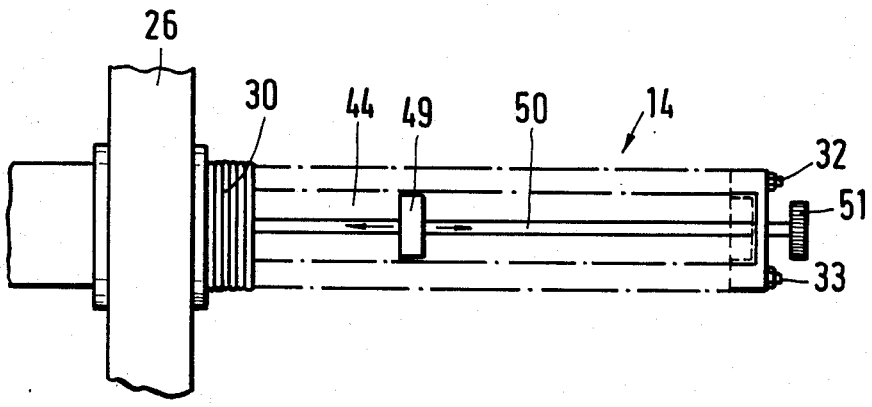
FIG. 6 is a downward plan view of the jet arm of FIG. 2 showing a displaceable sealing block.
Figure 5:
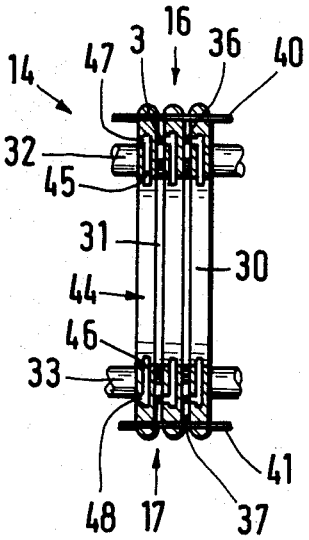
FIG. 5 is a cross-sectional view of a plurality of plates taken through the line A-B of FIG. 3.
Figure 3:
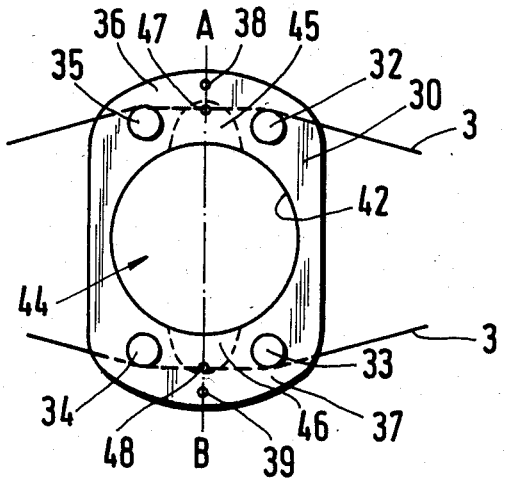
FIG. 3 is a side elevational view of a plate.
Figure 4:
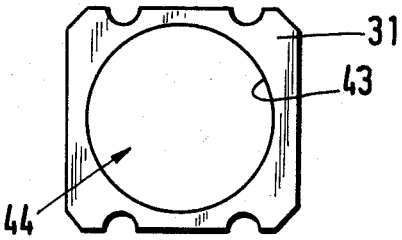
FIG. 4 is a side elevational view of a separation element.

FIG. 6 illustrates the provision of a sealing block 49 located in compressed air channel 44 which blocks off said channel. This block 49 is axially movable upon a setting screw 50 when the operating arrangement 51 at the open end of the jet arm 14 is activated. For example, the block 49 comprises an internal thread which interacts with the external thread of the setting screw. In this way all of the reservoir spaces 46 and 47 as well as the jets 47 and 48 which are located between the block 49 and the open end of the jet arm may be cut off from air supply. Thus, the slots 36, 37 which are not charged with threads can be cut off from the air supply.

As illustrated in FIG. 1, the jet arm 14 is so arranged that the slot rows 16 and 17 are provided substantially symmetrically above and below the plane combining the distribution reed 20 and the collection reed 22. The same applies with respect to jet arm 15 whose slot rows 18 and 19 are symmetrically oriented with respect to the distribution reed 21 and the collection reed 23. The two jet arms 14 and 15 themselves are located symmetrically above and below the plane connecting the distributing roller 12 and the collecting reed 24. The warp threads 3 are thus angularly displaced as little as possible from their common plane. Nevertheless, they do lie against the thread support pegs 32 to 35 under a modest amount of tension. This ensures a fairly substantial amount of regularity in the entanglement of the warp threads 3.

The air jets 47 and 48 direct a stream of air to the center of the thread. The air is then deflected back from the opposite plate 30 in accordance with the impact plate principle. It can then exit to the side and upwardly without a great deal of noise generation.

Figure 9:
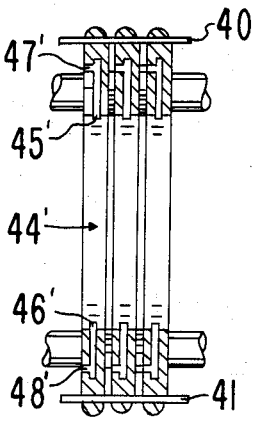
FIG. 9 is an elevational view of another plate embodiment which is an alternate to that of FIG. 5.

In FIG. 9 corresponding components have identical reference numerals, otherwise an apostrophe is added. It is also possible to construct the plates in such a manner that the reservoir spaces 45' and 46' are vented on both sides as air jets 47' and 48'. When this mode of construction is employed it is possible to provide each second plate out of solid material, that is to say, without jets or reservoir spaced (but of course retaining the common opening 44').

In this connection, the separation of the central level of the plates 30' from each other should be a maximum of 5 mm., preferrably less than 4 mm. Thus, per thread, one only requires a breadth of about 1 mm or less.

The construction of the entanglement arrangement is particularly advantageous when at least one jet arm is located after a wrap thread handling arrangement on which the warp threads are treated as a planar warp thread sheet. Thus, if the warp threads 3 are already running in a plane for purposes of treatment and thus receive equal treatment, it is most advantageous to separate the threads 3 as little as possible from each other and particularly to avoid irregularly strong angular deviations since otherwise the unitary nature of the warp thread sheet is lost. This is particularly true when the warp thread treatment arrangement is a heat stretching operation which ensures the equal stretching of the threads. If the threads 3 are thereafter subjected to unequal mechanical stresses, the regular nature of the warp thread sheet would be lost.

In operation, threads 3 are pulled from the spools 1 of creel 2 by rollers 7. Thereafter they are heated by arrangements 8 and 10. Threads 3 are fed through reeds 20 and 21 to arms 14, **14*a*, 15 and 15*a*. Compressed air is delivered through pipe 29 and valve 28 to channel 26. The pressurized air is conveyed through the openings 42 comprising the internal airway 44. The comressed air flows through reservoirs 45, 46 to jets 47, 48. The threads are held at the jets 47, 48 by being trapped between guides 32–35 and guards 40, 41. Accordingly, thread 3** is subjected to reliable entanglement from the compressed air.

After the entanglement stage, the threads 3 are routed through reeds 22 and 23 to collecting arrangement 24. After passing through optical detector 25, the threads 3 are delivered to a warp beam M in the usual fashion.

Figure 7:
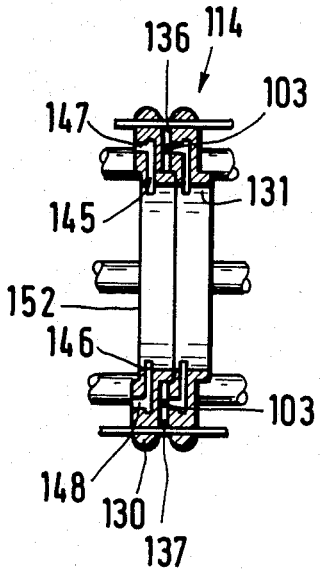
FIG. 7 is a cross-sectional view corresponding to that of FIG. 5 of another embodiment.
Figure 8:
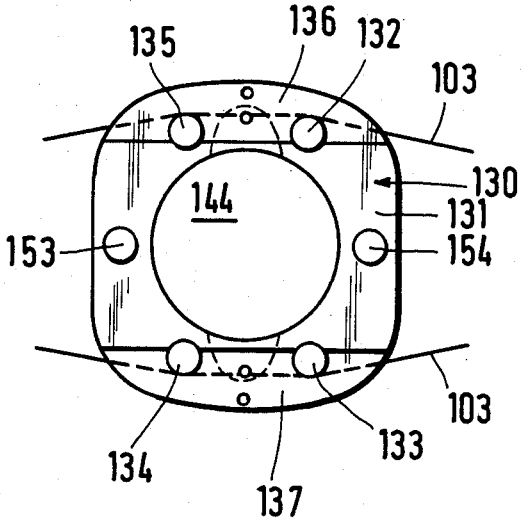
FIG. 8 is a side elevational view of a different plate embodiment which is an alternate to that of FIG. 5; and (9)

In the modification of FIGS. 7 and 8, the indicator numbers for the corresponding parts are raised by 100. This modification may be differentiated from that of FIGS. 3 through 5 in that the separating elements 131 are formed as protrusions in plates 130 which protrude into indentations 152 in the adjacent plate. The separating elements 131 are annular ridges bordering the airway 144 protruding from the plates 130 themselves and jutting into annular indentations 152 having a similar plan but a lesser depth than the protrusion of the neighboring plate. Thus, one may construct this portion of the device from the assembly of a plurality of similar elements. Because the indentation 152 has a lesser depth than the height of the protrusion, slots 136 and 137 are left between the plates 130. In this embodiment, however, additional tension bolts 153 and 154 are provided so that the thread supports 132 through 135 are formed by untensioned pegs. Where the plates 130 are constructed of ceramic material a good air seal is obtainable for the compressed air channel 144 even when the pressure is of the order of 4 bar or more.

Obviously, many modifications and variations of the present invention are possible in light of the above teachings. It is, therefore, to be understood that within the scope of the appended claims, the invention may be practiced otherwise than as specifically described.

What I claim is:

1. An arrangement for the entanglement of multi-filament thread, said arrangement being operable to entangle warp threads travelling from spools on a creel to a warping machine, said arrangement having a jet arm adapted to communicate with a source of compressed air, comprising:

a plurality of adjacently placed plates, each adjacent pair of said plates having a separating element located between each, said plates being positioned to provide between them a plurality of parallel channels, each of said channels being shaped as an outwardly directed slot having side walls formed by a corresponding adjacent pair of said plates, said slot having a base formed by the separating element corresponding thereto, for each adjacent pair of said plates at least one of them including: (a) a reservoir adapted to communicate with said source of compressed air, (b) an airway between said reservoir and said source of compressed air, and (c) a bore in the side wall communicating with said reservoir for acting as a perpendicularly directed air jet, said plates having in said slot upstream and downstream of said air jets at least one thread support for keeping the threads out a predetermined distance from the base of said slot and in the influence of said air jet.

2. An arrangement in accordance with claim 1 wherein the separating element comprises an integral protrusion in each of the plates, each of the plates facing said protrusion having an indentation of lesser depth for receiving said protrusion.

3. An arrangement in accordance with claim 1 wherein said separating element comprises a separate disk element, the plates having two, opposite, planar, parallel faces.

4. An arrangement in accordance with claim 3 wherein said separate disk comprises a gasket separating the slot from the airway.

5. An arrangement in accordance with claim 4 wherein said plates each have an opening forming said airway in said plates, the reservoir comprising a pair of pockets on opposite sides of the opening in the plates, said pockets having walls formed upon said plates and breached by the bore of said air jet.

6. An arrangement in accordance with claim 5 wherein said slots of said jet arm are arranged in two similar rows located upon opposite sides of the airway.

7. An arrangement in accordance with claim 4 wherein said plates are fabricated from ceramic material.

8. An arrangement in accordance with claim 7 wherein said plates are fabricated from an oxide ceramic.

9. An arrangement in accordance with claim 7 wherein said thread support comprises a peg located, in part, in the slot running through the jet arm.

10. An arrangement in accordance with claim 9 wherein said said peg comprises a tension bolt.

11. An arrangement in accordance with claim 9, further comprising:

an exit prevention means mounted at each slot for keeping said thread in the slot.

12. An arrangement in accordance with claim 11 wherein said exit prevention means comprises at least one wire, said plates each having a colinear aperture, said wire running through each aperture in said plates.

13. An arrangement in accordance with claim 12 further comprising:

a carrier having an air line and supporting said jet arm transversely, the airway running inside said jet arm communicating with said air line in the carrier.

* * * * *